United States Patent [19]

Fricker

[11] Patent Number: 4,821,994

[45] Date of Patent: Apr. 18, 1989

[54] MOLDING FOR THE RETENTION OF A TIE IN THE CONCRETING OF A PRECAST CONCRETE PART

[76] Inventor: Siegfried Fricker, Wurmberger Strasse 30-34, 7135 Wiernsheim, Fed. Rep. of Germany

[21] Appl. No.: 92,314

[22] Filed: Sep. 1, 1987

[30] Foreign Application Priority Data

Sep. 2, 1986 [DE] Fed. Rep. of Germany ..... 3629772

[51] Int. Cl.[4] ..... E04G 15/04

[52] U.S. Cl. ..... 249/91; 52/125.4; 52/125.5; 52/701; 52/704; 249/95; 249/177; 249/183; 249/185

[58] Field of Search ..... 249/63, 64, 66 R, 83, 249/91, 95, 96, 142, 170, 175, 177, 179, 180, 183, 184, 185, 219 R; 52/124.2, 125.1, 125.4, 125.5, 698, 699, 701, 704, 706, 707; 294/89, 90

[56] References Cited

U.S. PATENT DOCUMENTS 1,975,235 10/1934 Lowell ..... 52/125.5
3,187,694 6/1965 Crookston et al. ..... 249/83
4,367,892 1/1983 Holt ..... 52/125.5
4,383,674 5/1983 Fricker ..... 249/177

FOREIGN PATENT DOCUMENTS 3037596 12/1983 Fed. Rep. of Germany .

*Primary Examiner*—Jay H. Woo
*Assistant Examiner*—James C. Housel
*Attorney, Agent, or Firm*—Foley & Lardner, Schwartz, Jeffery, Schwaab, Mack, Blumenthal & Evans

[57] ABSTRACT

A molding for the retention of a tie during the concerning of a precast concrete part is provided. In the removal of the molding from the recess of the precast concrete part, the molding is drawn off from the tie, so that the tie head projects into a recess in the precast concrete part. So that it can be pulled out of the precast concrete part easily, the molding has at least one lifting-out part which is preferably in the form of a rope loop and which, on the lifting-out side facing away from the precast concrete part, can be bent into the plane of the lifting-out side or raised outward in order to pull out the molding.

12 Claims, 5 Drawing Sheets

MOLDING FOR THE RETENTION OF A TIE IN THE CONCRETING OF A PRECAST CONCRETE PART

BACKGROUND OF THE INVENTION

The invention relates to a molding for the retention of a tie in the concreting of a precast concrete part. In a known molding (German Patent Specification No. 3,037,596), blind-hole bores are made in the molding material at the head and are open on the top or lifting-out side facing away from the precast concrete part. After the setting of the concrete, two round bars can be inserted into these blind-hole bores, and the molding can subsequently be removed from the precast concrete part by pressing these round bars together in a scissor-like manner. However, during the installation or production of the precast concrete part, the blind-hole bores may be filled with concrete so that the round bars cannot be inserted, thereby making it impossible to lift out the molding. A further disadvantage of this known molding is that, in order to lever the molding out of the precast concrete part, a reliable supply of round bars which fit into the blind-hole bores of the molding is necessary.

SUMMARY OF THE INVENTION

One object of the invention is to provide a molding which is reliably removable from the precast concrete part by simple means and without special levering-out bars.

Preferred embodiments and developments, further advantages and essential details of the invention are described in the following description and drawings which illustrate preferred exemplary embodiments in a diagrammatic representation.

DETAILED DESCRIPTION OF THE PREFERRED EMBODIMENTS

Figure 1:
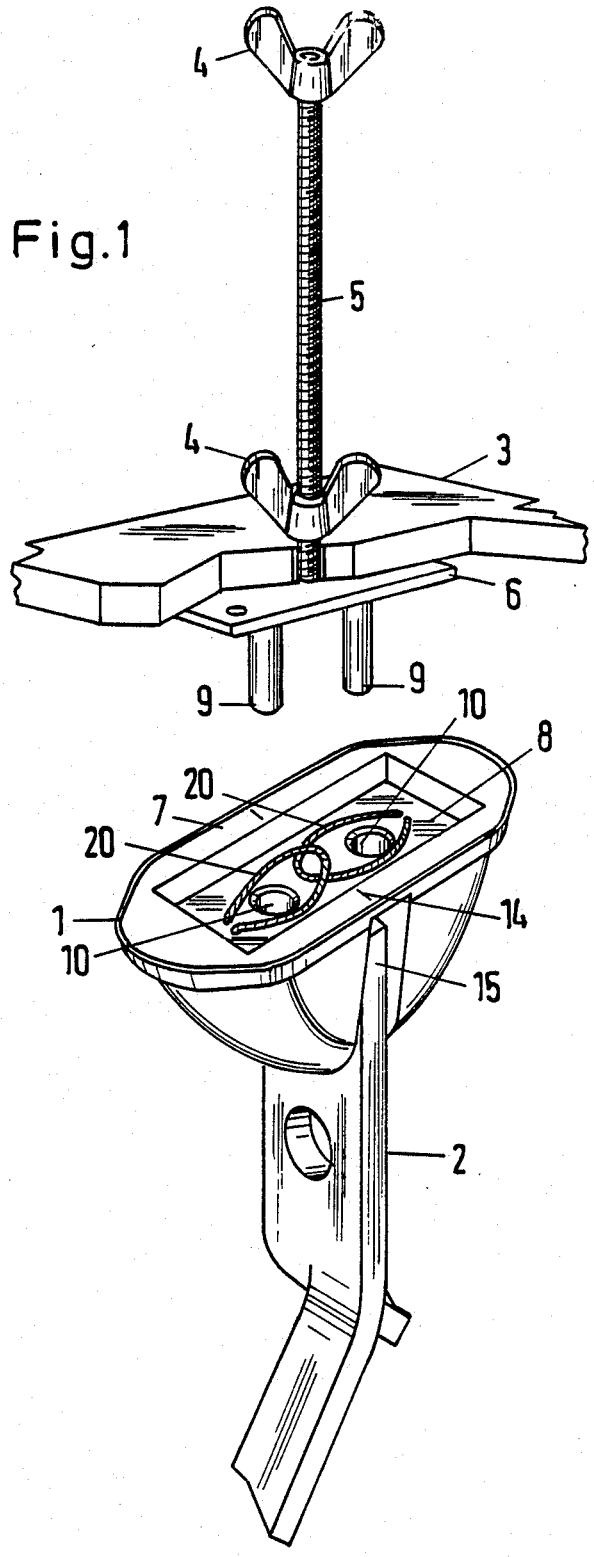
FIG. 1 is a perspective fragmentary view of a molding according to the invention, with a tie and part of some formwork.

The molding 1 according to the invention can be cast, together with a tie 2, into a precast concrete part (not shown) by means of a formwork 3. For retention purposes, a threaded screw 5 having wing nuts 4 passes through the formwork 3, and under the formwork 3 there is a retaining plate 6 which can be inserted into a rectangular recess 8 formed in the upper lifting-out side

7, in such a way that a substantially planar closure is obtained. Two cylindrical pegs 9 which are inserted into two bores 10 of the molding 1 are located on the underside of the retaining plate 6.

Figure 6:
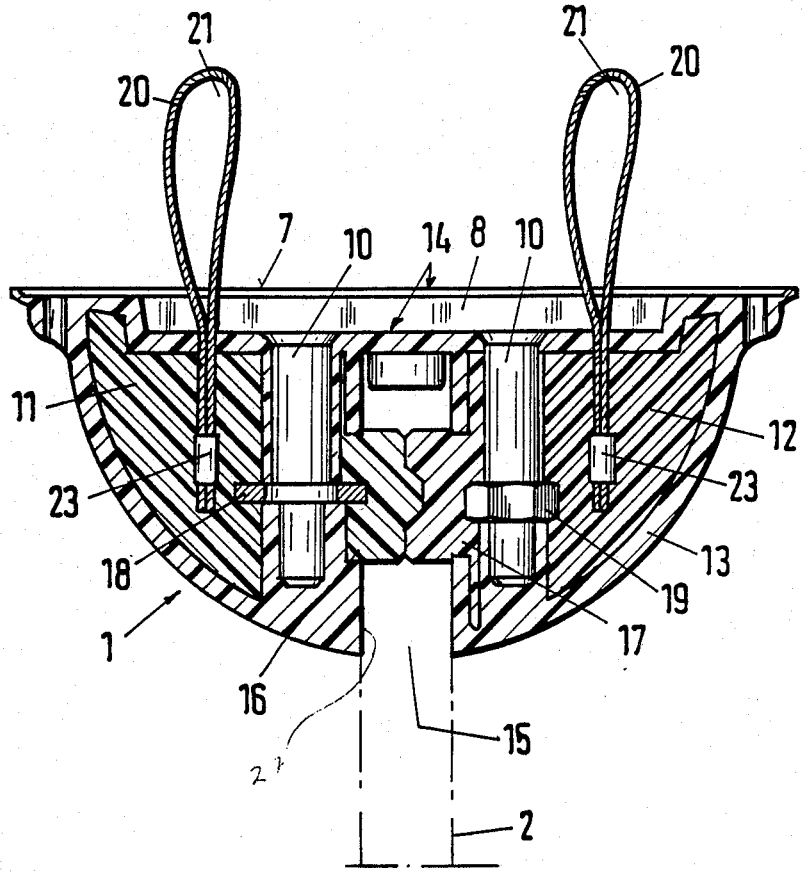
FIG. 6 is a cross-sectional view of the molding in FIG. 2 taken along the line VI—VI.

As best seen in FIG. 6, the molding 1 comprises two molding core parts 11, 12 which have high material stability and which can preferably be produced from polyamide, thus giving the molding 1 a high inherent rigidity. Core parts 11 and 12 jointly define a slot 27 for receiving the tie 2. The core parts 11, 12 are surrounded by a casing 13 which consists of a flexible material which can preferably be produced from an elastic polyurethane resistant to the chemical and physical effects of the concrete or formwork material (formwork oil or the like) and which are capable of withstanding mechanical loads which occur when the tie 2 is laid in place and when the molding 1 is removed from the precast concrete part. The flexible casing 13 is designed so that a predetermined bending point 14 similar to a film hinge is produced at the bottom of the recess 8, in the central region, so that the two sides of the molding 1, together with the two core parts 11, 12, can be bent upwards about the axis of the predetermined bending point 14 to thereby disengage the lugs 16, 17 from an orifice in the tie head 15 and release the tie 2.

The bores 10 for fastening the molding 1 to the formwork 3 are spaced from one another at respective left and right positions of the predetermined bending point 14. The bore 10 shown on the left in FIG. 6 has, in the lower region, a metal plate 18 having shaped receiving portions for peg retention.

In the lower region of the other bore 10, shown on the right in the drawing, is a threaded nut 19 into which a peg thread can be threaded so that the lifting-out side 7 of molding 1 can be drawn up against the inner face of the formwork 3.

FIGS. 1, 2, 6 and 7 show that the molding 1 has at least one lifting-out part 20. In the molding 1 of FIGS. 1, 2 and 6, there are two lifting-out parts 20, while only a single lifting-out part 20 is providing in the molding 1 of FIG. 7. The lifting-out part 20 is preferably a wire rope or a cord, and is preferably shaped as a sling or loop to form an insertion orifice 21. An auxiliary tool, such as, for example, a so-called bricklayer's hammer which is typically readily available to concrete workers in their daily work, can be inserted into orifice 21 in order to lever the molding 1 out of the precast concrete part. As shown in FIG. 8 the lifting part may also be produced from metal sheet to form a flat-rectangular shackle **20*a*, for example, which resembles a hinge, and can be provided with a hole 20*b* into which the auxiliary tool or the bricklayer's hammer can be introduced. If the sling-shaped lifting-out part 20 is designed as a rope, it preferably is made of metal wires or of a plastic cord having high tearing resistance. Furthermore, lifting-out part 20 may be integrally produced with the material of the molding 1**.

If the lifting-out parts 20 are produced separately and secured to the molding 1, it is advantageous to bend the ends of the lifting-out part 20 into the form of a wire rope having hooks 22 (FIG. 3), for example, by means of which a reliable anchoring in the material of the molding 1 can be achieved. According to the exemplary embodiment of FIG. 4, the ends of the rope-shaped lifting-out part 20 can be joined together by means of a pinch sleeve 23 to secure the part 20 in the molding 1. This embodiment is shown in FIG. 6. According to the exemplary embodiment of FIG. 5, the ends of the rope loop 20 are joined together by a threaded bolt 24, whereby a firm anchoring in the molding 1 can be achieved. It is within the scope of the invention to also secure the lifting-out part 20 in the molding 1 by means of variously shaped barb-like fastening end parts so that part 20 is prevented from being torn out. For example, a thread can be cast in the molding 1, by means of which a mating thread of the lifting-out part 20 can be screwed in.

The lifting-out part 20 can appropriately be positioned on the molding 1 in such a way that it is located inside the tray-shaped recess 8 on the upper head side or lifting out side 7. It is advantageous to provide the parts or slings 20 of such dimension that the total length or the sum of the lengths of the lifting-out slings is no greater than the length of the recess. This ensures that the lifting-out parts 20 can always be accommodated completely in the recess 8 and can be arranged in a countersunk manner. For this purpose, it is preferable to arrange the lifting-out slings 20 in such a way that they are embedded somewhat obliquely in the molding 1, that is, so that the two lifting-out parts are somewhat inclined towards one another, thereby defining an oblique position inclined inward toward the center of the molding. This ensures that, when the molding 1 is secured against the formwork 3, the lifting-out slings 20 automatically fold inward and bend into the recess 8.

Figures 2, 3, 4, 5:
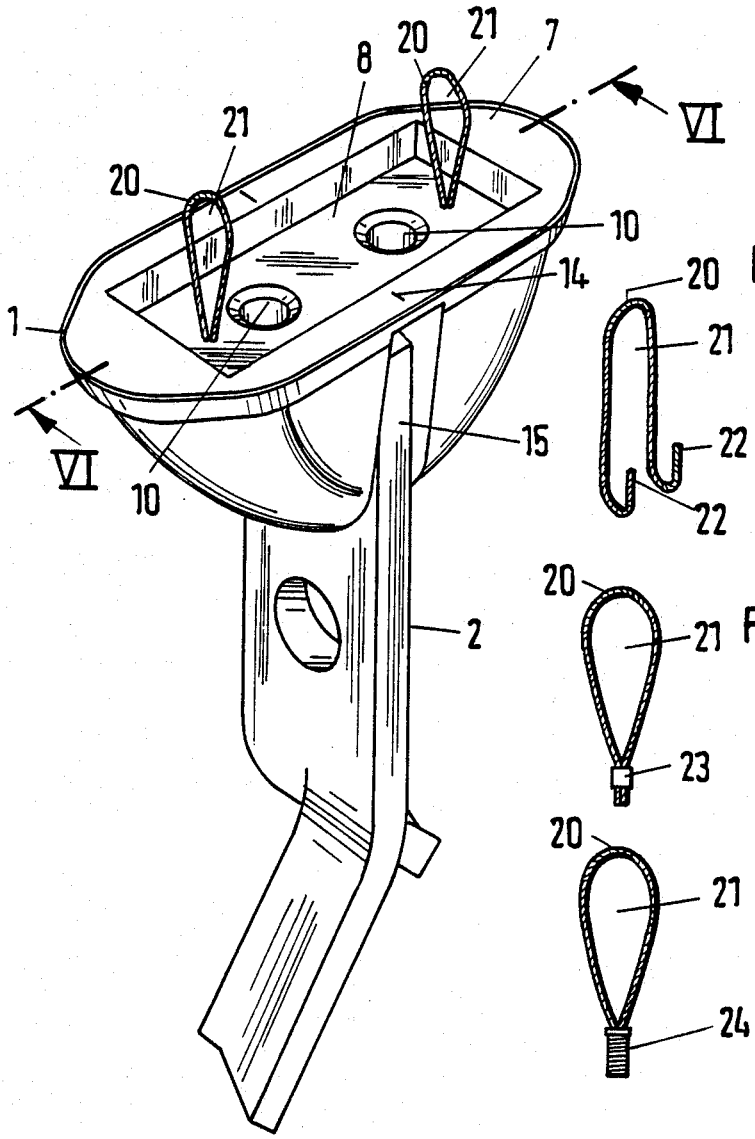
FIG. 2 is an enlarged perspective of the molding and the tie according to FIG. 1.
FIG. 3 is a perspective view of a hook-shaped lifting-out part of the molding similar to that of FIGS. 1 and 2.
FIG. 4 is a side view of a loop-shaped lifting-out part according to FIGS. 1 and 2, with a pinch sleeve.
FIG. 5 is a side view of a loop-shaped lifting-out part according to FIGS. 1 and 2, with a threaded bolt.

In the exemplary embodiment of FIGS. 1, 2 and 6, each of the two lifting-out parts 20 is fastened in one of the two molding core parts 11, 12, and preferably cast in the plastic material to ensure positive anchoring. It can be seen that the lifting-out loops 20 are at an even greater distance from one another than the two bores 10 of the molding 1. The loop-shaped lifting-out parts are thus anchored in the molding core parts 11, 12 on the left and right, respectively, of the bores 10, by means of their pinch sleeves 23, so that relatively large moment arms from the lifting-out parts 20 to the predetermined bending point 14 located at mid-distance are obtained which facilitate the levering of the molding 1 out of the precast concrete part.

In FIGS. 2 and 6, the lifting-out parts 20 are erect and project above the upper lifting-out side 7. A bricklayer's hammer or the like can be inserted into the insertion orifices 21 in order to lift out the molding 1. In FIG. 1, the lifting-out parts 20 in the form of rope loops are bent inward toward each other and are fully disposed within in the recess 8.

Figure 7:
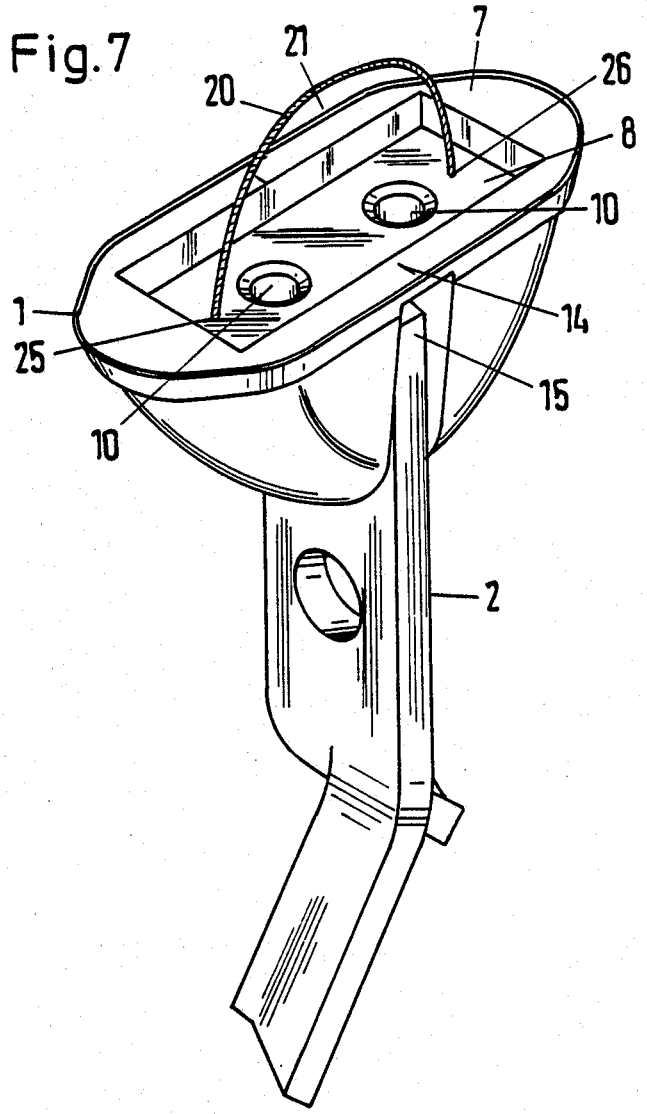
FIG. 7 is a perspective view of a molding with the tie similar to that of FIG. 2, but with a different lifting-out part.
Figure 8:
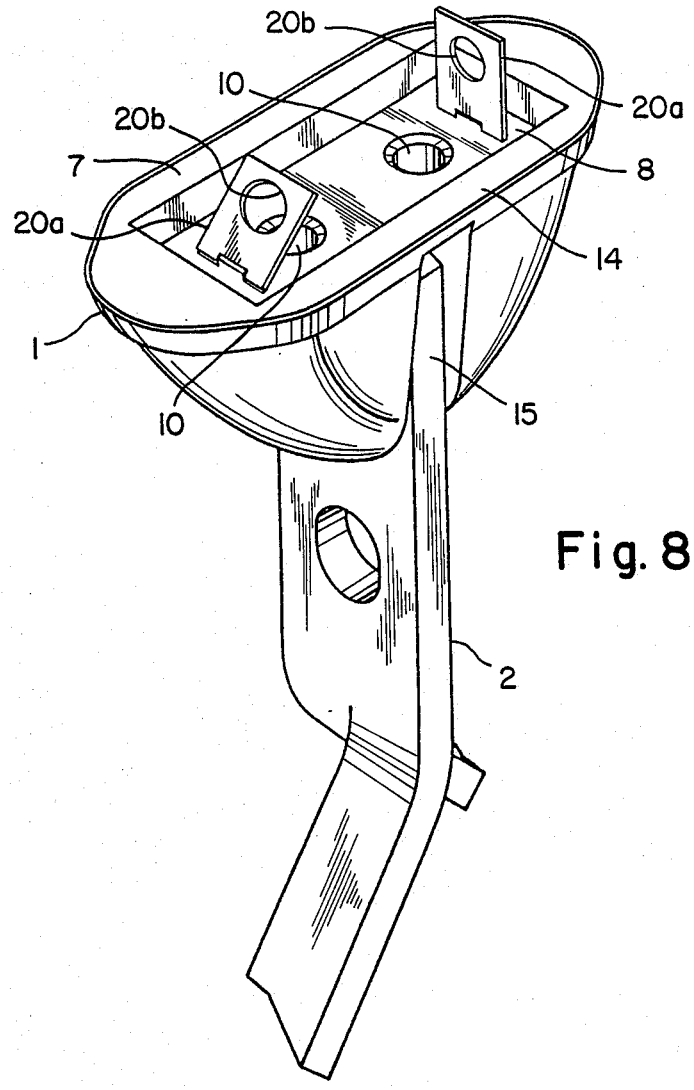
FIG. 8 is a perspective view of the molding and tie similar to FIGS. 1, 2 and 7, with a flat, rectangular lifting-out part.

In the exemplary embodiment illustrated in FIG. 7, the single wire-shaped lifting-out part 20 is arranged arcuately in the region of the recess 8, thus forming an arch or bow which spans the predetermined bending point 14 and the two bores 10 in the molding 1. One end 25 of the rope-shaped lifting-out bow 20 is cast firmly in the molding core part 11 and the other end 26 is cast firmly in the molding core part 12 of the molding 1. The ends 25, 26 can be bent into hooks 22 similar to those shown in FIG. 3. When the molding 1 is assembled, the lifting-out part 20 in the form of a wire bow can likewise be bent so that it is arranged inside the recess 8. The advantage of this design is that only one auxiliary tool, such as a bricklayer's hammer, need be inserted in the center of the lifting-out part 20 to lever out the molding 1, and the hammer need only be pulled in a direction vertically upward, since the molding 1 easily tips upwards in the center about the predetermined bending point 14. A uniform distribution of the lifting-out forces on both sides of the molding 1 is also achieved in this embodiment.

The inherent stability or inherent rigidity of the lifting-out parts 20, which are preferably wire or plastic slings, produces the advantage that, if the molding 1 is installed in a large surface and the concrete is subsequently skimmed or smoothed, the molding 1 can always be easily located by the wire slings 20 which resiliently return to upright positions even when molding 1 has been sunk slightly into the concrete. During the skimming or smoothing of the concrete surface, the surface of the molding 1 is covered with a thin concrete layer of approximately 2 to 5 mm, so that the lifting-out side 7 of the molding 1 is no longer visible. The lifting-out parts 20 according to the invention achieve the advantage that the resilient wire slings always bend up again easily out of this covering concrete layer as a result of their inherent spring effect, so that the particular position of the molding 1 can be clearly recognized.

Another advantage of the lifting-out parts 20, which are preferably in wire loops, is that, after the concrete has set, the bricklayer's hammer can simply be used as a hook to lever out the molding 1, because the tip of the bricklayer's hammer can be guided through the sling and the molding 1 can be lifted out upward by being pulled at an angle. Yet another advantage is that, when the molding 1 is threaded on, the lifting-out parts 20 in the form of rope loops fold easily and enter the recess 8 of the molding 1. After the molding 1 has been removed from the formwork 3, the wire loops can spring back and are thus ready to use again immediately. A further advantage is that there are no longer any lifting-out bores which can become clogged, and the lifting-out slings 20 can be hooked at any time by means of simple, readily available auxiliary tools so as to pull the molding 1 out without difficulty.

I claim:

1. An apparatus for positioning a tie having an orifice within a precast concrete part while the precast concrete part is being formed, comprising:

a molding removeably securable to the tie, the molding comprising:

a top surface adapted to face outward from the precast concrete part when the tie is positioned within the precast concrete part;

a slot for receiving the tie, the slot having a bottom lying along an axis;

lug means insertable into the orifice of the tie when the tie is inserted into the slot, the lug means being moveable out of engagement with the tie upon outward flexing of the molding about the axis, and lifting out means foldable below the top surface of the molding but adapted to project outwardly beyond the top surface of the molding for removal of the molding from a cast concrete part, whereby the molding flexes outwardly in response to a force applied to the lifting out means so as to move the lug means out of engagement with the tie.

2. An apparatus as claimed in claim 1 wherein the lifting out means comprises a rope.

3. An apparatus as claimed in claim 1 wherein the lifting out means comprises a loop defining an insertion orifice for receiving an auxiliary tool.

4. An apparatus as claimed in claim 1 wherein the lifting out means comprises a flat shackle having an insertion orifice.

5. An apparatus as claimed in claim 1 wherein the lifting out means is formed integrally with the molding.

6. An apparatus as claimed in claim 1 wherein the lifting out means is embedded in the molding by means of an anchoring means.

7. An apparatus as claimed in claim 1 wherein the molding comprises a recess formed in the top surface and the lifting out means is secured to the molding at the bottom of the recess.

8. An apparatus as claimed in claim 7 wherein the lifting out means is dimensioned to fold within the length of the recess.

9. An apparatus as claimed in claim 7 wherein the lifting out means is inclined relative to a plane parallel to the bottom of the recess.

10. An apparatus as claimed in claim 1 wherein the molding further comprises two molding core parts retained within an elastic casing.

11. An apparatus as claimed in claim 10 wherein the lifting out means comprises two lifting out parts.

12. An apparatus as claimed in claim 10 wherein the lifting out means straddles the slot.

* * * * *